US012808097B2

(12) United States Patent
Colot

(10) Patent No.: US 12,808,097 B2
(45) Date of Patent: Nov. 24, 2026

(54) THREE-DIMENSIONAL WEAVING METHOD WITH YARN EXIT

(71) Applicant: SAFRAN, Paris (FR)

(72) Inventor: Marc-Antoine André Louis Colot, Moissy-Cramayel (FR)

(73) Assignee: SAFRAN, Paris (FR)

( * ) Notice: Subject to any disclaimer, the term of this patent is extended or adjusted under 35 U.S.C. 154(b) by 0 days.

(21) Appl. No.: 19/470,411

(22) PCT Filed: Mar. 28, 2024

(86) PCT No.: PCT/FR2024/050397
§ 371 (c)(1),
(2) Date: Sep. 29, 2025

(87) PCT Pub. No.: WO2024/200968
PCT Pub. Date: Oct. 3, 2024

(65) Prior Publication Data

US 2026/0117432 A1 Apr. 30, 2026

(30) Foreign Application Priority Data

Mar. 31, 2023 (FR) ..... FR2303164

(51) Int. Cl.
*D03D 25/00* (2006.01)

(52) U.S. Cl.
CPC ..... *D03D 25/005* (2013.01); *D10B 2505/02* (2013.01)

(58) Field of Classification Search
CPC .... D03D 25/005; D03D 47/271; D03D 41/00; D03D 41/004; D03D 15/00; D10B 2505/02
See application file for complete search history.

(56) References Cited

U.S. PATENT DOCUMENTS

2008/0261474 A1* 10/2008 Goering ..... B29C 70/24 28/103
2009/0311462 A1* 12/2009 Goering ..... B29B 11/16 442/205

(Continued)

FOREIGN PATENT DOCUMENTS

EP 0 573 132 A1 12/1993
FR 3074195 A1 * 5/2019 ..... D03D 25/00
WO WO 2006/136755 A2 12/2006

OTHER PUBLICATIONS

Machine translation (French to English) of FR 3074195 A1, accessed from EPO Espacenet on Mar. 19, 2026 (Year: 2026).*

(Continued)

*Primary Examiner* — Patrick J. Lynch
*Assistant Examiner* — Brianna T. Duckworth
(74) *Attorney, Agent, or Firm* — CUSHMAN PARTNERS LLC

(57) ABSTRACT

A method for weaving a texture between warp yarns and weft yarns by a weaving loom including at least one rapier able to pass through the loom along a reference path and to draw a weft yarn, the method including at least displacing at least part of the warp yarns intended to be exited from the texture, so that the yarns are disposed on one side of the reference path and so that the rest of the non-exited warp yarns is disposed on another side of the reference path, then the rapier passing through the weaving loom along the reference path without drawing any weft yarn.

10 Claims, 7 Drawing Sheets

(56) References Cited

U.S. PATENT DOCUMENTS

| | | | | |
|---|---|---|---|---|
| 2019/0224885 | A1* | 7/2019 | Risicato | B29B 11/16 |
| 2024/0117533 | A1* | 4/2024 | Jones | D03D 11/00 |

OTHER PUBLICATIONS

International Search Report as issued in International Patent Application No. PCT/FR2024/050397, dated Jul. 18, 2024.
International Preliminary Report on Patentability and then Written Opinion of the International Searching Authority as issued in International Patent Application No. PCT/FR2024/050397, dated Jul. 18, 2024.

* cited by examiner

[Fig. 1]
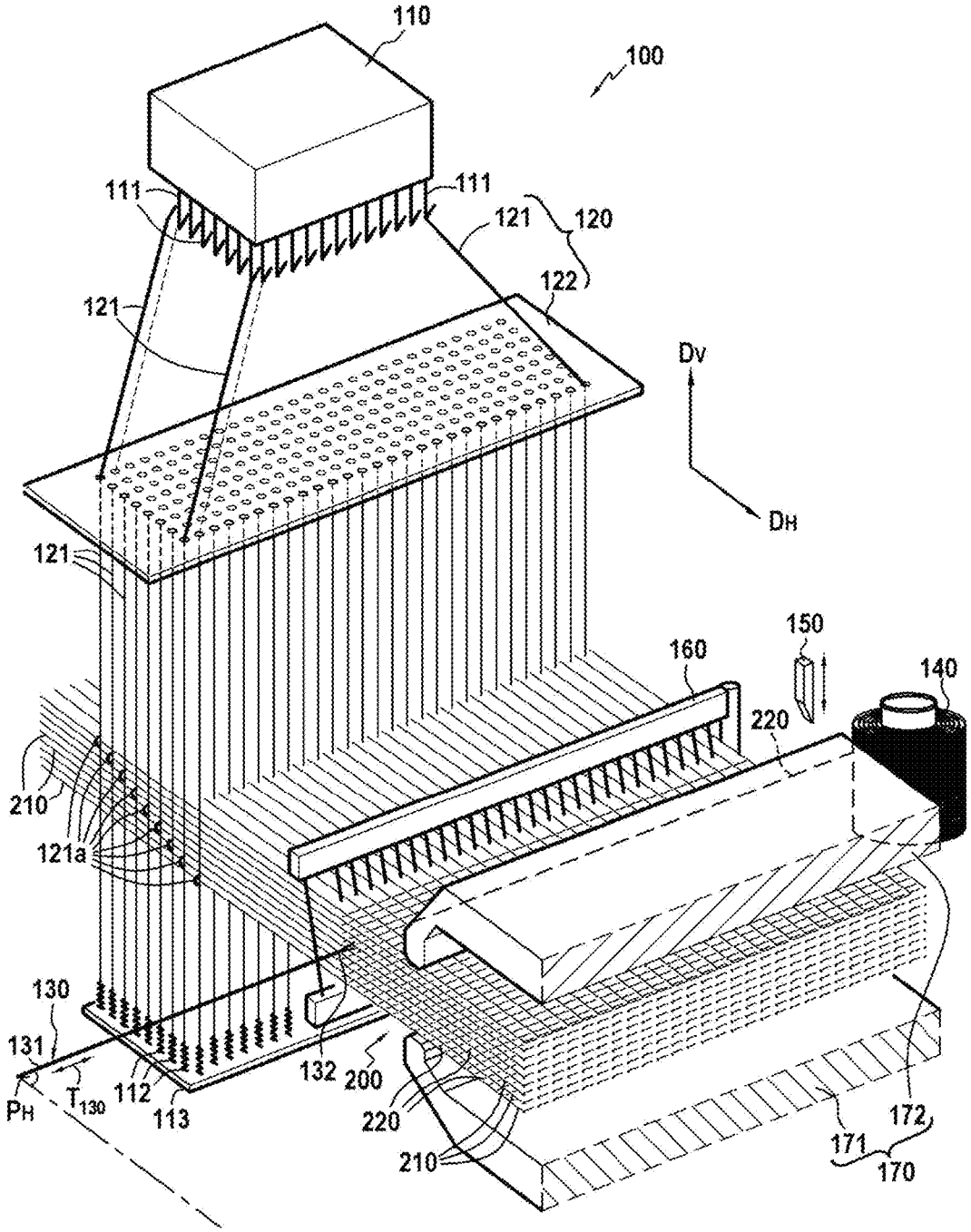

[Fig. 2]
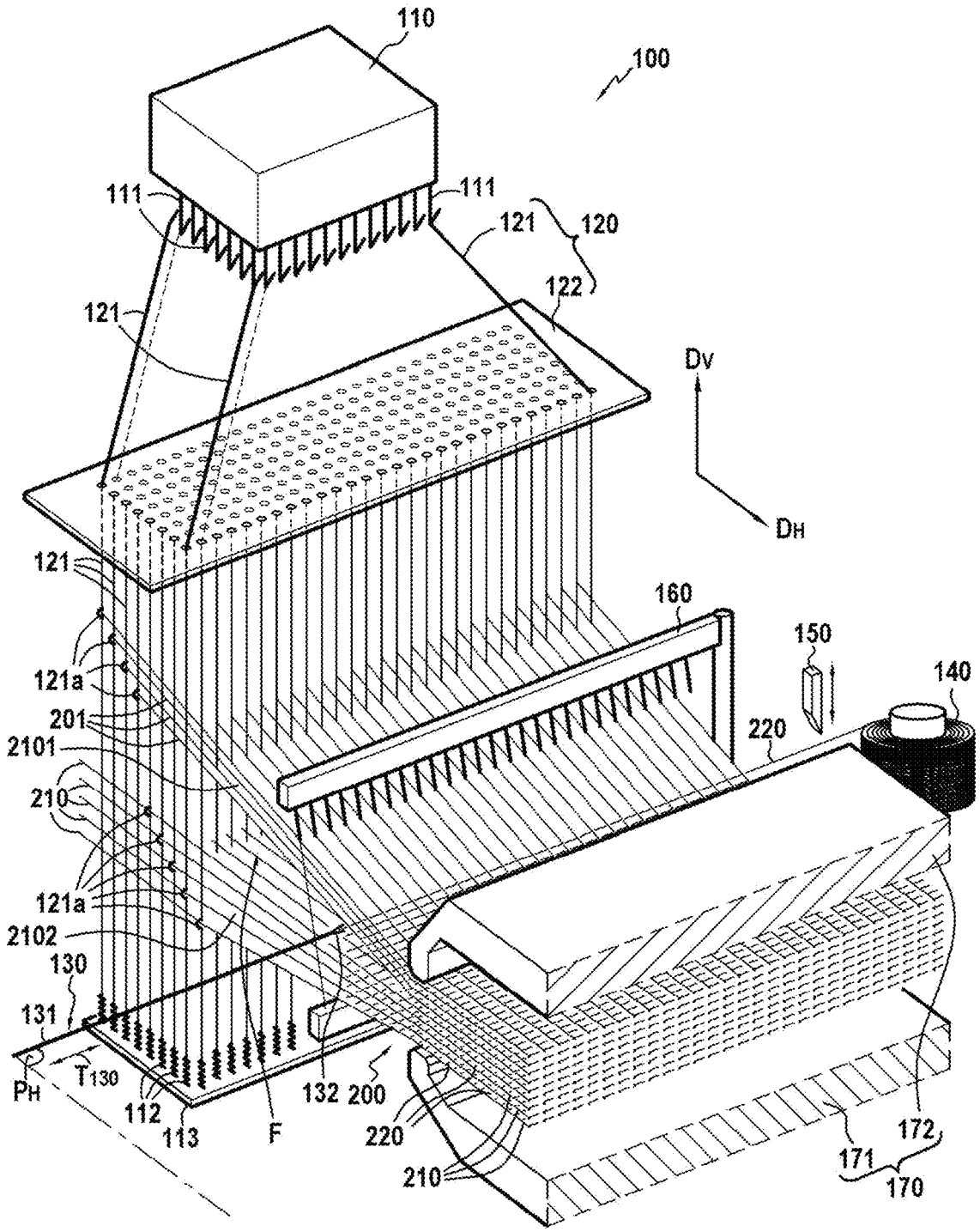

[Fig. 3]
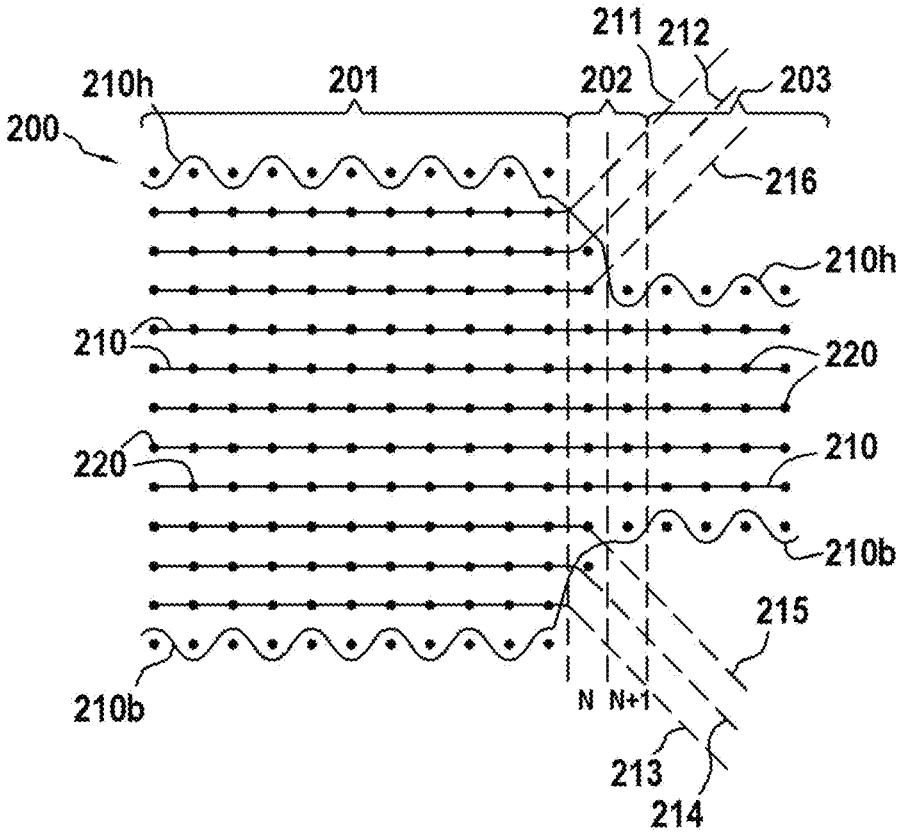

[Fig. 4]
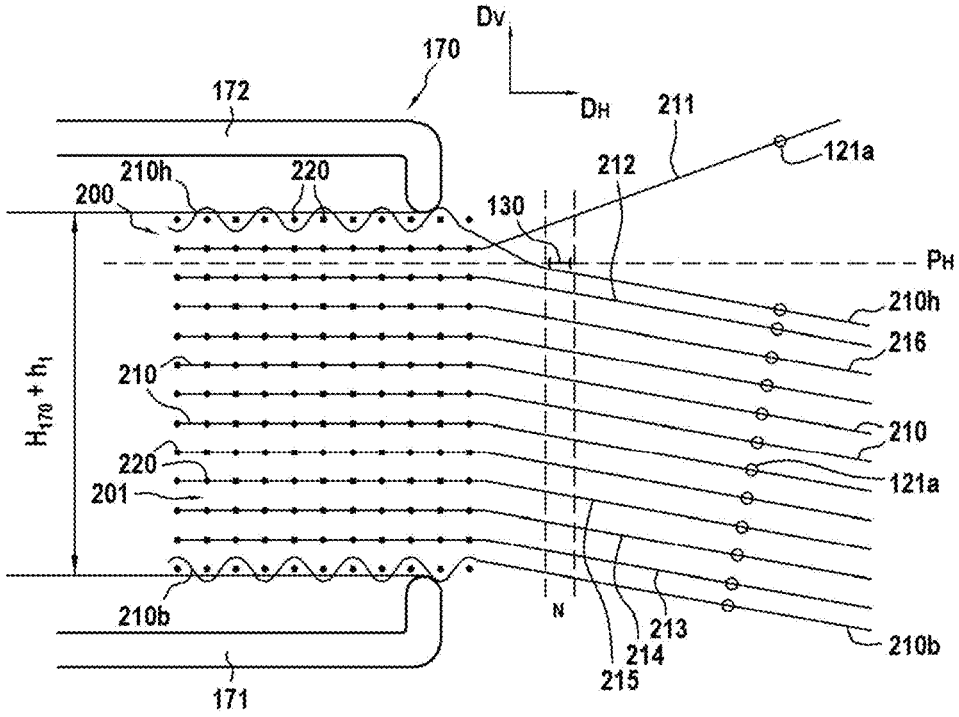
[Fig. 5]
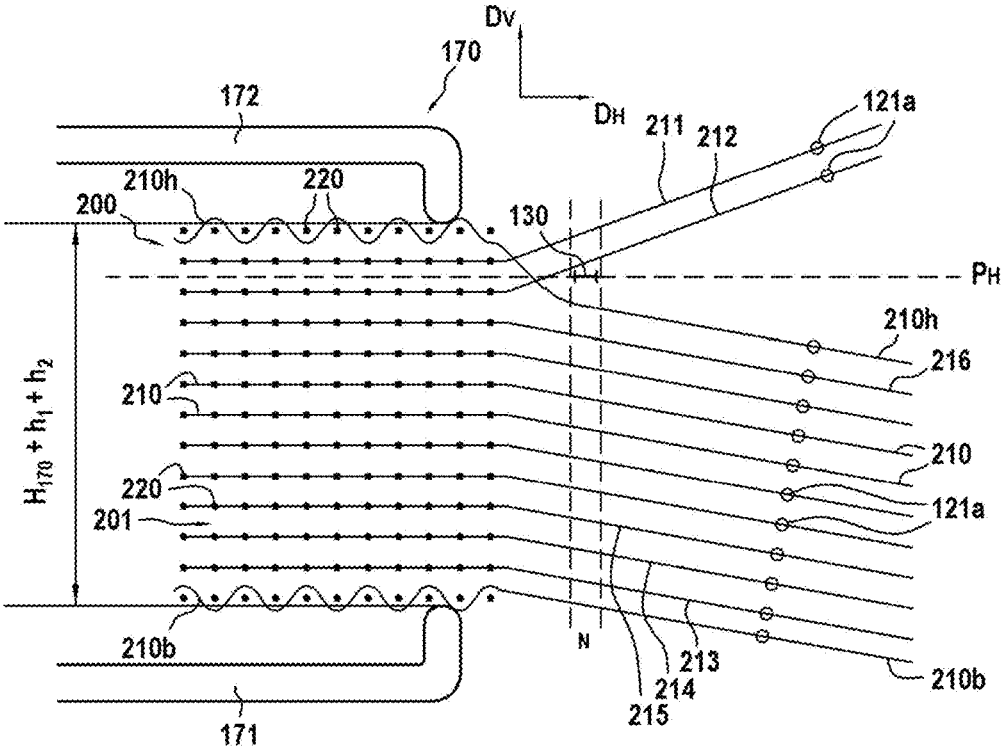

[Fig. 6]
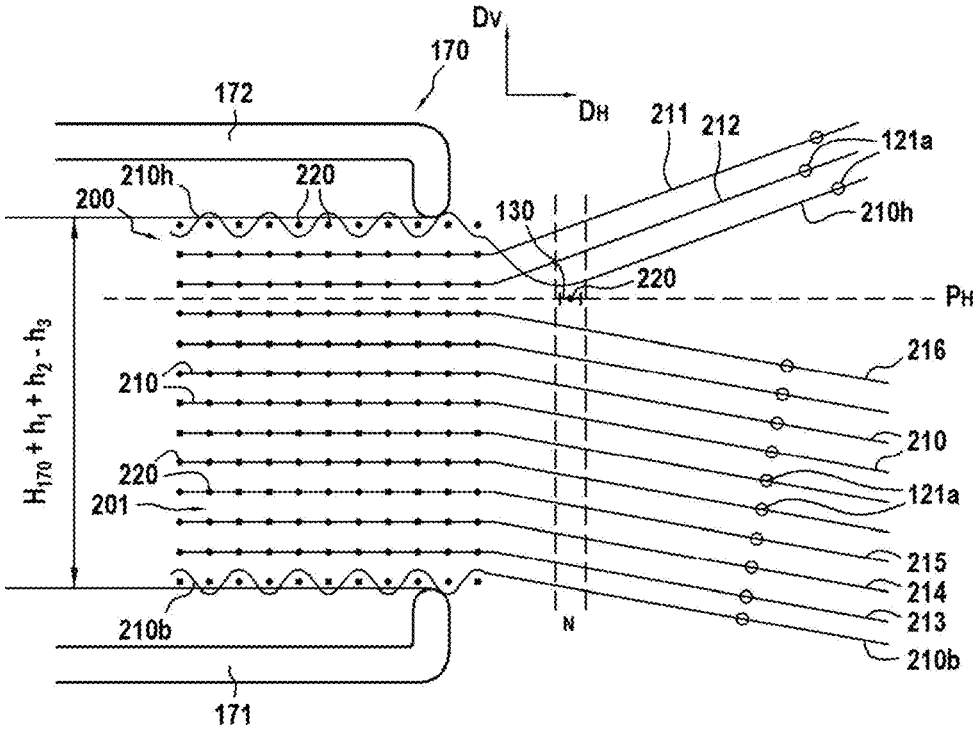
[Fig. 7]
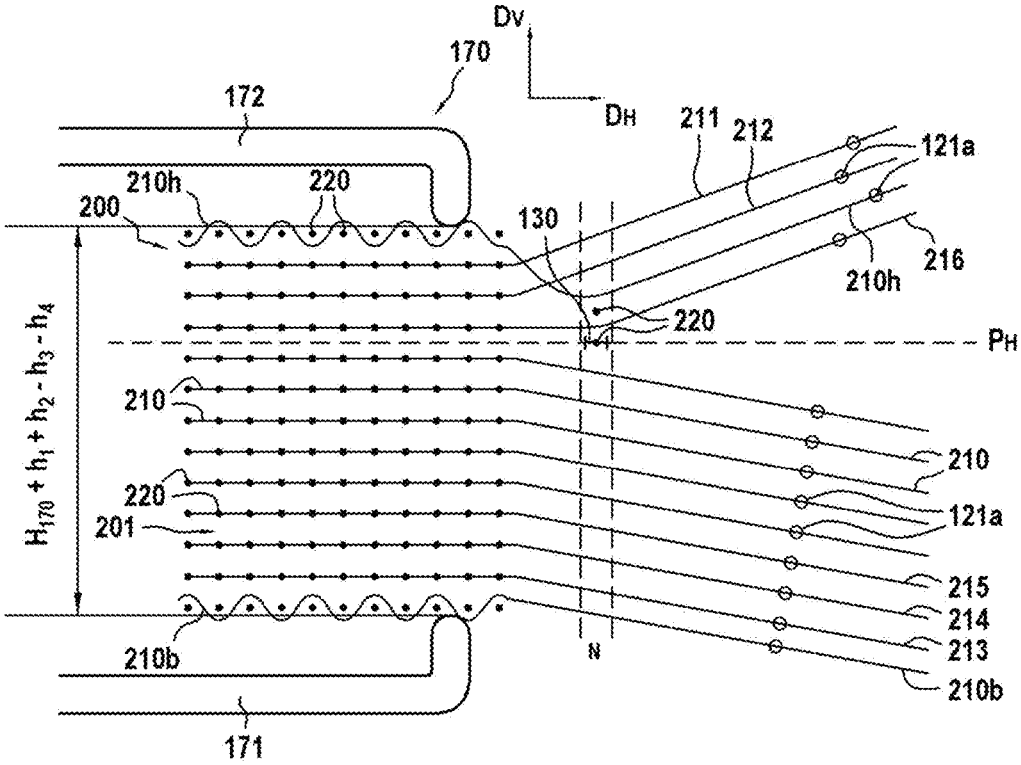

[Fig. 8]
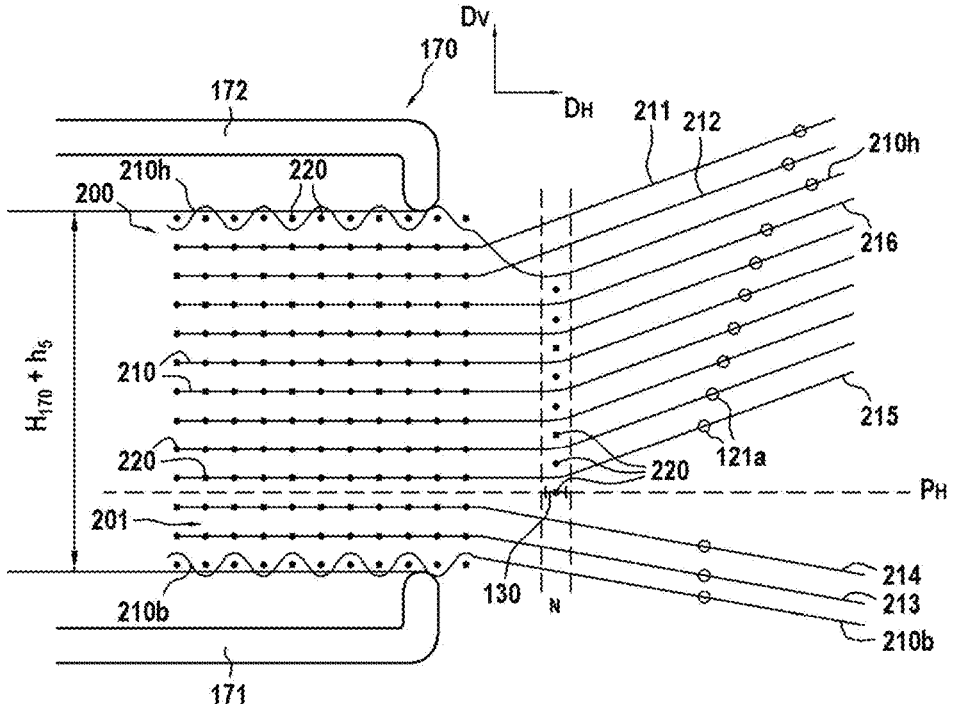
[Fig. 9]
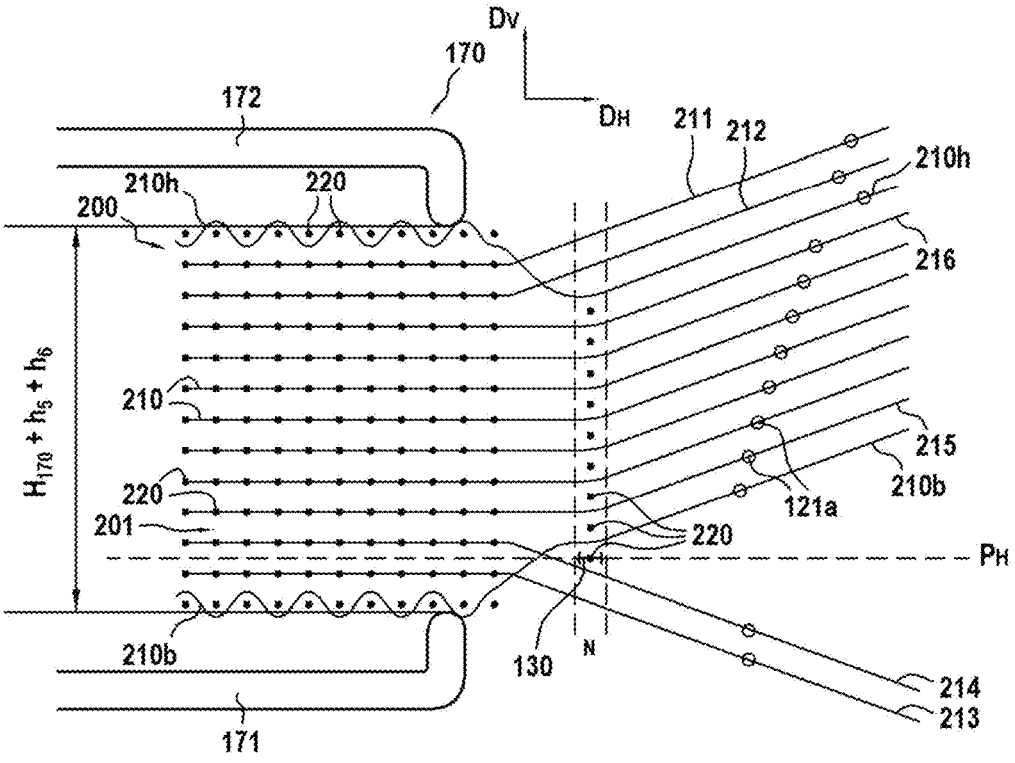

[Fig. 10]
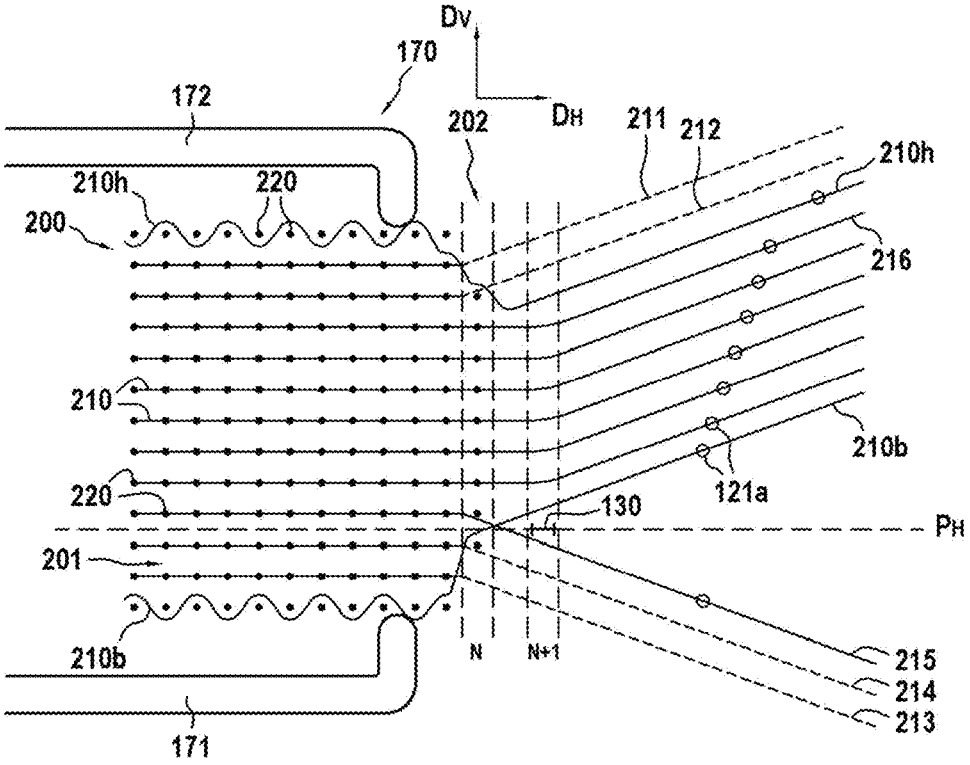
[Fig. 11]
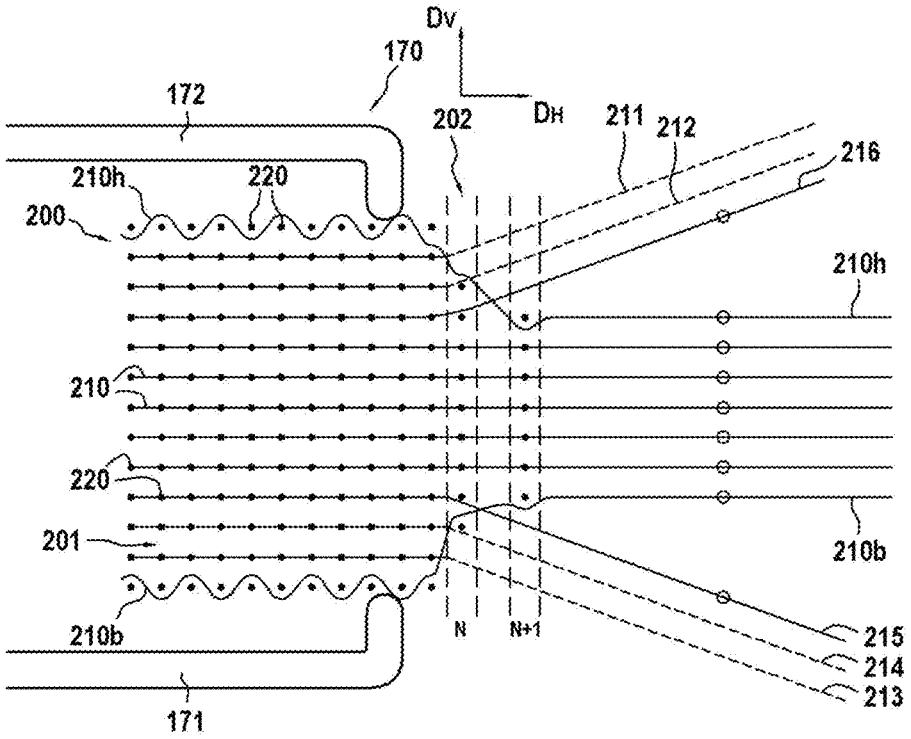

THREE-DIMENSIONAL WEAVING METHOD WITH YARN EXIT

CROSS-REFERENCE TO RELATED APPLICATIONS

This application is the U.S. National Stage of PCT/FR2024/050397, filed Mar. 28, 2024, which in turn claims priority to French patent application number 2303164 filed Mar. 31, 2023. The content of these applications are incorporated herein by reference in their entireties.

TECHNICAL FIELD

The present invention relates to the three-dimensional weaving of woven textures using a Jacquard-type weaving loom, and particularly to the textures having thickness variations requiring yarn exits.

PRIOR ART

A Jacquard-type weaving loom is conventionally used to make textures by three-dimensional weaving between a plurality of layers of warp yarns and a plurality of layers of weft yarns. Such a weaving loom is in particular described in document FR 3 074 195 A1, in the name of the Applicant.

As is known, the weaving loom is equipped with a Jacquard mechanism. The loom also comprises a harness including control yarns or heddles, each control yarn being connected at one end to a control element of the Jacquard mechanism.

Each control yarn comprises an eyelet through which a warp yarn passes. The control yarns and their associated eyelet are able to move vertically. The control yarns allow lifting some warp yarns and thus creating a shed, that is to say an opening between lower and upper webs of warp yarns. Said shed thus opened allows the introduction of a weft yarn by means of a rapier, said rapier having a fixed vertical position. The rapier comprises a rod which can be equipped at its end with a clamp that grips a weft yarn from a bobbin to place it through the opening between the webs of warp yarns created by the shed, the weft yarn being cut using a cutting tool after its positioning in the shed.

When it is desired to make thick woven textures comprising a thickness variation, it may be necessary to exit yarns at the location of the thickness decrease so that they are not woven. In order to maintain a satisfactory and continuous surface condition of the woven texture, it is generally sought to exit yarns present in underlying layers of warp yarns, which are therefore not present on the surface. Thus, by actuating the control yarns, the warp yarns are displaced in the harness so that the warp yarns to be exited pass through the layer of surface warp yarns and are placed out of the path of the rapier. The other yarns are then woven conventionally, from the upper layer of surface warp yarns to the lower layer of surface warp yarns.

However, the crossing of the warp yarns to be exited with the surface warp yarns can generate friction and tension, particularly when the warp yarns to be exited must pass through many layers of warp yarns. The associated control yarn eyelets can thus become incorrectly positioned in the harness, and significant tension can be generated in the control yarns. In particular, a phenomenon of progress of the control yarns can be observed, which results in a vertical misalignment of the control yarns which engage into the reed of the weaving loom. The friction and the stress applied on the control yarns can then generate regular interruptions of the weaving, or even a prolonged stoppage of the weaving. Furthermore, if the warp yarns are incorrectly positioned in the harness, warp yarns to be exited may become stuck at the level of the layers of surface warp yarns and thus be woven by mistake.

DISCLOSURE OF THE INVENTION

The present invention aims to overcome the aforementioned drawbacks by proposing a weaving method that allows making woven textures by a three-dimensional weaving comprising yarn exits through layers of warp yarns.

To this end, the invention proposes a method for three-dimensionally weaving a texture between a plurality of layers of warp yarns superimposed along a vertical direction and a plurality of weft yarns extending along a horizontal direction, the weaving being performed by means of a weaving loom comprising a plurality of control yarns, a first end of each control yarn being connected to a Jacquard mechanism able to displace the control yarns along the vertical direction between a neutral position and at least one position for opening the warp yarns, each control yarn being further provided with an eyelet through which a warp yarn passes, the weaving loom further comprising at least one rapier present downstream of the control yarns able to pass through the weaving loom along a fixed horizontal reference path and to draw a weft yarn from a bobbin, characterized in that the method further comprises at least one warp yarn exit step comprising:

displacing, along the vertical direction, all or part of the warp yarns of at least one underlying layer of warp yarns of the plurality of layers of warp yarns, said displaced warp yarns being intended to be exited from the texture, over a determined distance extending beyond a layer of warp yarns present on the surface of the plurality of layers of warp yarns, so that the displaced warp yarn(s) are disposed above the reference path and so that the rest of the non-exited warp yarns is disposed below the reference path, or so that the displaced warp yarn(s) are disposed below the reference path and so that the rest of the non-exited warp yarns is disposed above the reference path, then the rapier passing through the weaving loom along the reference path without drawing any weft yarn.

By performing an empty rapier pick, in other words a "rapier airpick", it is made sure to correctly separate the warp yarns to be exited from the layers of warp yarns to be woven, even when the warp yarns to be exited must cross many layers of surface warp yarns or even when a significant number of warp yarns have been displaced in the harness. It is consequently made sure to correctly position the warp yarns to be exited relative to the warp yarns to be woven. The movement of the control yarns and of the associated eyelets in the harness, which are disposed in the correct position without generating tension or friction, is thus facilitated. The stress on the control yarns are greatly limited, which allows for smoother weaving with few interruptions. Weaving errors generated by improper placement of the control yarns in the harness are also reduced. The weaving speed can therefore be increased, while improving the quality of the weaving obtained.

According to one particular embodiment of the invention, during the weaving of at least one weft column, a plurality of underlying layers of warp yarns is intended to be exited from the texture beyond one of the layers of warp yarns present on the surface of the plurality of layers of warp yarns, the following warp yarn exit step being repeated for each layer of warp yarns to be exited beyond said layer present on the surface:

displacing, along the vertical direction, the layer of warp yarns to be exited over a determined distance extending beyond the layer of warp yarns present on the surface of the plurality of layers of warp yarns, so that the displaced layer of warp yarns is disposed above the reference path and below the previously displaced layers of warp yarns intended to be exited from the texture and so that the rest of the non-exited warp yarns is disposed below the reference path, or so that the displaced layer of warp yarns is disposed below the reference path and above the previously displaced layers of warp yarns intended to be exited from the texture and so that the rest of the non-exited warp yarns is disposed above the reference path; then the rapier passing through the weaving loom along the reference path without drawing any weft yarns.

By performing the exits of the layers of warp yarns one after the other, with a rapier airpick for each displaced layer of warp yarns, the number of simultaneous crossings with the layer of surface warp yarns is limited. The exit of the layers of warp yarns is therefore facilitated and is performed while generating very little stress at the level of the harness.

According to another particular embodiment of the invention, the warp yarn exit step further comprises, after the rapier has passed through the weaving loom without drawing any weft yarns:

part of the displaced warp yarns or part of the displaced layer moving along the vertical direction so that said part of the displaced warp yarns or of the displaced layer is disposed below the reference path and so that the other part of the displaced warp yarns or of the displaced yarn layer is disposed above the reference path, then the rapier passing through the weaving loom along the reference path by drawing a weft yarn so as to interlink the displaced warp yarns together.

Thus, after the warp yarns have been exited using rapier airpicks, the exited warp yarns can be interlinked together to reduce the risk that some exited warp yarns could be mistakenly woven with the texture, and to facilitate subsequent cutting of the exited warp yarns.

Preferably, the exited warp yarns are interlinked with a two-dimensional weave.

According to another particular embodiment of the invention, the weaving loom further comprises a guide device present downstream of the plurality of control yarns and of the rapier, the guide device being able to move along the vertical direction so as to move the woven texture upwards or downwards relative to a horizontal reference plane comprising the reference path.

Since the reference path of the rapier is fixed vertically, such a guide device able to vertically move the texture makes it easier to perform rapier airpicks, or rapier picks with a weft yarn, in the highest and lowest layers of warp yarns. Furthermore, such a guide device allows displacing the texture as each weft column is woven to be positioned in the best position in order to facilitate the uncrossing of the warp yarns and improve the positioning of the texture relative to the shed opening used.

The guide device may further comprise an upper guide bar and a lower guide bar configured to be positioned in the contact with the woven texture and on either side of said texture along the vertical direction, the minimum value of the spacing between the guide bars corresponding to the thickness of the non-compacted woven texture.

Furthermore, the woven texture according to the invention may be abundant and require subsequent compacting. Thus, it is preferable to have sufficient spacing between the guide bars so as not to distort the texture. Moreover, the proper execution of the warp yarn exits may require very large shed openings. However, a too small spacing between the guide bars may prevent the implementation of large shed openings.

According to another particular embodiment of the invention, the spacing between the guide bars increases during the displacement along the vertical direction of all or part of the warp yarns intended to be exited from the texture over a determined distance extending beyond a layer of warp yarns present on the surface of the plurality of layers of warp yarns.

Indeed, the execution of warp yarn exits requires large height amplitudes of the eyelets in the harness, as well as very wide shed openings. By increasing the spacing between the guide bars during the crossing between the yarns to be removed and the surface yarns, the possible shed opening is greatly increased and the risk of generating tension on the eyelets of the harness is reduced.

According to another particular embodiment of the invention, the guide bars of the guide device are configured to move along the vertical direction as a function of the vertical position of the eyelets of the harness during the displacement along the vertical direction of all or part of the warp yarns intended to be exited from the texture over a determined distance extending beyond a layer of warp yarns present on the surface of the plurality of layers of warp yarns, so that in each plane of the weaving loom perpendicular to the reference path, the length between the harness and the woven texture of the lowest warp yarn located above the reference path corresponds to between 90% and 110% of the length between the harness and the woven texture of the highest warp yarn located below the reference path.

Thus, the displacement of the guide bars of the guide device is a function of the positions of the eyelets in the harness. By ensuring that the lengths of the crossing yarns are similar, it is possible to avoid generating significant tension in some yarns that could draw on the eyelets and generating stress in the harness.

According to another particular embodiment of the invention, the guide device is configured to move between a first position and a second position along the vertical direction as a function of the vertical position of the eyelets of the harness after the displacement along the vertical direction of all or part of the warp yarns intended to be exited from the texture over a determined distance extending beyond a layer of warp yarns present on the surface of the plurality of layers of warp yarns, so that in each plane of the weaving loom perpendicular to the reference path, the length between the harness and the woven texture of the highest warp yarn located below the reference path when the guide device is in the first position is comprised between 90% and 110% of the length between the harness and the woven texture of said warp yarn when it is the lowest located above the reference path when the guide device is in the second position.

Thus, the warp yarns swinging from the lower edge of the shed to the upper edge of said shed after a rapier pick do not undergo excessive tension, thus facilitating yarn crossings.

According to another particular embodiment of the invention, the warp and weft yarns are carbon, glass or ceramic fibers.

According to another particular embodiment of the invention, the woven texture is intended to form a fibrous reinforcement for a composite material part of an aeronautical engine.

Indeed, the manufacture of many composite material parts for aeronautics involves performing a three-dimensional weaving of significant thickness requiring yarn exits to achieve thickness variations.

BRIEF DESCRIPTION OF THE DRAWINGS

FIG. 1 is a schematic perspective view of a Jacquard-type weaving loom in the neutral position.

FIG. 2 is a schematic perspective view of the weaving loom of FIG. 1 with shed creation.

FIG. 3 is a schematic sectional view of a woven texture made by the method of the invention.

FIG. 4 is a schematic sectional view of the weaving loom of FIGS. 1 and 2 during the exit of a first layer of warp yarns through the upper layer of warp yarns of a first weft column.

FIG. 5 is a schematic sectional view of the weaving loom of FIGS. 1 and 2 during the exit of a second layer of warp yarns through the upper layer of warp yarns of the first weft column.

FIG. 6 is a schematic sectional view of the weaving loom of FIGS. 1 and 2 during the weaving of the upper layer of warp yarns of the first weft column.

FIG. 7 is a schematic sectional view of the weaving loom of FIGS. 1 and 2 during the weaving of an underlying layer of warp yarns of the first weft column.

FIG. 8 is a schematic sectional view of the weaving loom of FIGS. 1 and 2 at the end of weaving of all the underlying layers of warp yarns to be woven of the first weft column.

FIG. 9 is a schematic sectional view of the weaving loom of FIGS. 1 and 2 during the weaving of the lower layer of warp yarns of the first weft column.

FIG. 10 is a schematic sectional view of the weaving loom of FIGS. 1 and 2 during the exit of a fifth layer of warp yarns through the upper layer of warp yarns of a second weft column.

FIG. 11 is a schematic sectional view of the weaving loom of FIGS. 1 and 2 at the end of the weaving of all the layers of warp yarns to be woven of the second weft column.

DESCRIPTION OF THE EMBODIMENTS

The invention generally applies to three-dimensional weaving methods for making woven textures between layers of warp yarns and layers of weft yarns. By "three-dimensional weaving" it is meant here a weaving mode by which at least some of the warp yarns interlink weft yarns over several weft layers. It is considered that a woven texture made by three-dimensional weaving may comprise another type of weaving on its surface, for example two-dimensional weaving, in order to improve its surface condition.

The woven texture may for example have a three-dimensional weave of the interlock or multi-satin type. Different three-dimensional weaving modes that can be used to form the woven texture are described in document WO 2006/136755.

FIGS. 1 and 2 illustrate a weaving loom 100 for carrying out the weaving method of the invention. The weaving loom 100 according to the invention allows obtaining a woven texture 200 extending in length along a horizontal direction $D_H$ and in thickness along a vertical direction $D_V$ by weaving a plurality of layers of warp yarns 210 with a plurality of layers of weft yarns 220.

The weaving loom is equipped with a Jacquard mechanism 110 supported by a superstructure not represented in FIGS. 1 and 2. The loom 100 also comprises a harness 120 including control yarns or heddles 121, each control yarn 121 being connected at one end to a control element 111 of the Jacquard mechanism 110. In the example illustrated in FIGS. 1 and 2, each control yarn 121 is connected at one end to a control hook 111 of the Jacquard mechanism 110 and at the other end to a return spring 112 fixed to the frame 113 of the weaving loom 100. The control yarns 121 extend along the vertical direction $D_V$. The harness 120 may also comprise a tying-up board 122.

Each control yarn 121 comprises an eyelet 121*a* through which a warp yarn 210 passes. Each warp yarn 210 of the loom 100 passes through an eyelet 121*a* of the harness 120. The warp yarns 210 are organized at the level of the harness 120 of the weaving loom 100 in a plurality of horizontal layers and vertical columns which are manipulated by the weaving loom 100 to allow the insertion of weft yarns 220 according to the weaving pattern(s) programmed in the weaving loom 100. The weft yarns 220 are inserted between the warp yarns 210 in columns extending along the vertical direction $D_V$. In order to allow the introduction of each column of weft yarns 220 during the weaving of the texture 200, a warp yarn take-up system 210 (not represented in FIGS. 1 and 2) is associated with the weaving loom 100. This system, placed downstream of the weaving loom 100, has the role of holding all the warp yarns 210 together in a clamping device and of allowing the progress of the warp yarns 210 by a determined distance along the horizontal direction $D_H$ after the insertion of each weft column 220.

The terms "upstream" and "downstream" are defined here according to the direction progress of the warp yarns 210 in the weaving loom 100, that is to say according to the weaving direction, along the horizontal direction $D_H$.

The control yarns 121 and their associated eyelet 121*a* are able to move along the vertical direction $D_V$. In FIG. 1, all the control yarns 121 are in a neutral position in which no traction is exerted by the Jacquard mechanism 110. In this configuration, no shed is created and all the warp yarns 210 extend parallel to the horizontal direction $D_H$.

During the creation of a shed, as illustrated in FIG. 2, part of the control yarns 121 is subjected to tensile forces exerted by the control hooks 111. In this configuration, the control yarns allow raising or lowering warp yarns, so as to separate an upper web 2101 of warp yarns from a lower web 2102 of warp yarns by an opening F, called shed. Several different sheds can be made by modifying the warp yarns raised or lowered using the control yarns 121.

The weaving loom 100 also comprises a rapier 130, present downstream of the control yarns 121. The rapier 130 is composed of a rod 131 whose first end is connected to an actuation system (not represented in FIGS. 1 and 2) that allows driving the rod 131 in a back-and-forth movement along a horizontal reference path $T_{130}$, said reference path $T_{130}$ being fixed relative to the frame 113 of the weaving loom 100. The reference path $T_{130}$ belongs to a horizontal reference plane $P_H$ extending along the horizontal direction $D_H$. The other end of the rod 131 is provided with a clamp 132 which, after having passed through the shed during the outward path of the rod 131, can grip a weft yarn 220 stored on a bobbin 140 to unwind it in the shed during the return path of the rod 131. The weft yarn 220 thus placed inside the shed is then cut in the vicinity of the bobbin 140 by a cutting tool 150 and released at its other end by the clamp 132. A comb 160 present upstream of the rapier 130 and downstream of the harness 120 in its rest position is then folded down in order to pack the weft yarn(s) 220 introduced into the shed. In accordance with the invention, the rod 131 can also make the outward and return path without the clamp 132 gripping a weft yarn 220: a rapier airpick is then performed. The rapier 130 is then ready to grip a new weft yarn 220 from the bobbin 140 and place it either in the same shed or in a different shed depending on the defined weaving. The woven texture 200 having a three-dimensional weaving between the warp yarns 210 and the weft yarns 220 is gradually formed.

Preferably, the weaving loom 100 further comprises a device 170 for guiding the woven texture 200 present downstream of the control yarns 121 and of the rapier 130. Such a guide device 170 is described in particular in document FR 3 074 195 A1. More generally, guide means are known from document EP 0 573 132 A1. In the example described here, the guide device 170 may comprise a lower guide bar 171 and an upper guide bar 172 each connected to an actuation means (not represented in FIGS. 1 and 2) which is able on the one hand to hold the woven texture 200 and on the other hand to displace the guide bars 171 and 172 along the vertical direction $D_V$. The guide device 170 allows displacing the woven texture along the vertical direction $D_V$ upwards or downwards relative to the horizontal reference plane $P_H$ comprising the horizontal reference path $T_{130}$ of the rapier 130. It is thus easier to create sheds at the level of the lower or upper layers of warp yarns 210, even with a large number of layers of warp yarns 210 superimposed in the vertical direction $D_V$.

As illustrated in the figures, the guide device 170 can displace the entire woven texture along the vertical direction $D_V$. According to another example not illustrated, a selvedge area disposed on each edge of the woven texture can be displaced along the vertical direction $D_V$ independently of the rest of the woven texture, by a guide device specific to this area. In other words, the guide device can be independent of the selvedge areas, each selvedge area being able to have a guide device specific to this area, so as to move the selvedge area in the vertical direction $D_V$.

The weaving method according to the invention allows making a woven texture 200 comprising at least a first portion 201 and a second portion 203. One example of a woven texture 200 that can be made by the method of the invention is schematically illustrated in FIG. 3. For reasons of clarity and simplification of the diagrams, the texture represented in the example illustrated in FIGS. 3 to 11 comprises a small number of warp yarns and weft yarns, and the weave of said texture is not represented.

The first portion 201 of the texture 200 is made by three-dimensional weaving between a first number of warp yarns 210 and a first number of weft yarns 220. The second portion 203 of the texture 200 is made by three-dimensional weaving between a second number of warp yarns 210, less than the first number of warp yarns 210, and a second number of weft yarns 220. The second number of weft yarns 220 is preferably less than the first number of weft yarns 220. Thus, the texture 200 may have a thickness variation, the second portion 203 being able to be thinner than the first portion 201.

The texture 200 also comprises a transition portion 202 between the first portion 201 and the second portion 203, in which the number of woven warp yarns 210 decreases from the first portion 201 to the second portion 203. The transition portion 202 connects the first portion 201 to the second portion 203 in the weaving direction. The transition portion 202 may correspond to a single weft column or to several weft columns N and N+1 of the texture 200.

The weaving method according to the invention comprises a first step, in which the three-dimensional weaving of the first portion 201 of the texture 200, which is preferably a very thick portion, is performed. The first portion 201 of the texture 200 is made in a well-known manner by three-dimensional weaving between the first number of warp yarns 210 and the first number of weft yarns 220 using the weaving loom 100 previously described.

When the weaving of the first portion 201 of the texture 200 is completed, the second step of the weaving method according to the invention begins, in which the transition portion 202 of the texture 200 is made. During this second step, a certain number of warp yarns are exited from the weaving to reduce the first number of warp yarns and obtain the second number of warp yarns.

In order to obtain a woven texture 200 with a satisfactory and continuous surface condition between the first portion 201 and the second portion 203, it is desired to remove from the weaving warp yarns belonging to underlying layers of warp yarns, that is to say not belonging to the upper layer of warp yarns **210*h* or to the lower layer of warp yarns 210*b***. Preferably, it is desired to remove warp yarns not belonging to the upper layers of warp yarns or to the lower layers of warp yarns. Consequently, each warp yarn or each layer of warp yarns desired to be removed from the weaving must pass through one or more upper or lower layers of surface warp yarn along the vertical direction $D_V$.

For each weft column of the transition portion 202 to be made, if it is desired to remove from the weaving warp yarns through the upper layer of surface warp yarns **210*h*** along the vertical direction $D_V$, the sub-steps described below are carried out.

According to a first sub-step, the warp yarns to be removed, or the entire layer(s) of warp yarns to be removed, are disposed above the reference path $T_{130}$ of the rapier 130 relative to the vertical direction $D_V$, and the rest of the warp yarns is disposed below the reference path $T_{130}$ of the rapier 130 relative to the vertical direction $D_V$. A shed is thus created separating the warp yarns to be removed, or the entire layer(s) of warp yarns to be removed, from the rest of the warp yarns, said shed comprising the reference path $T_{130}$. This configuration is obtained by actuating the control yarns 121 of the harness 120, so as to arrange the eyelets **121*a* through which the warp yarns to be removed pass, above the eyelets 121*a* through which the rest of the warp yarns 210** pass.

The terms "above" and "below" must be understood along the vertical direction $D_V$, and preferably relative to the direction of gravity.

Preferably, this configuration is also obtained by arranging the lower and upper guide bars 171 and 172 of the guide device 170 of the woven texture 200 in a vertical position that allows arranging the warp yarns to be removed, or the entire layer(s) of warp yarns to be removed, above the reference path $T_{130}$ of the rapier 130, and so as to arrange the rest of the warp yarns 210 below the reference path $T_{130}$ of the rapier 130.

Preferably, the vertical position of the lower and upper guide bars 171 and 172 of the guide device 170 is determined so that, in each plane of the weaving loom 100 perpendicular to the reference path $T_{130}$ of the rapier 130, the length between the harness 120 and the woven texture 200 of the warp yarn which delimits the lower edge of the shed corresponds to between 90% and 110% of the length between the harness 120 and the woven texture 200 of the warp yarn which delimits the upper edge of the shed. The length between the harness 120 and the woven texture 200 is understood as the length between the point of said warp yarn present at the downstream end of the harness 120 and the point of said warp yarn present at the upstream end of the woven texture 200. Thus, significant differences in yarn length are avoided between the warp yarns to be removed placed above the reference path $T_{130}$ of the rapier 130 and the other warp yarns placed below the reference path $T_{130}$ of the rapier 130, which further reduces the risk of tension in the harness and facilitates the crossing between the warp yarns to be exited and the surface warp yarns.

When the warp yarns to be removed are properly placed relative to the other warp yarns 201 and relative to the reference path $T_{130}$ of the rapier 130, a second sub-step is carried out according to which the rapier 130 is sent so that it passes through the weaving loom 100 along the reference path $T_{130}$ without drawing any weft yarn 220. Thus, the rapier 130 performs an unloaded/empty pick, referred to as "airpick". This airpick allows in particular properly positioning the warp yarns to be exited relative to the other warp yarns 210, for example when the warp yarns to be exited must pass through more than four layers of warp yarns. The comb 160 can be folded down after the airpick has been performed. The second sub-step is carried out after the first sub-step.

The first and second sub-steps can be repeated several times in each weft column of the transition portion to be made when it is desired to remove from the weaving, through the upper layer of surface warp yarns **210*h*, warp yarns belonging to underlying layers of warp yarns. Thus, the first and second sub-steps can be carried out for each layer of warp yarns to be exited through the upper surface layer 210*h*. Thus, by performing a rapier airpick 130 between each layer of warp yarns to be exited in the same weft column of the transition portion 202 to be made, it is easier to position the layers of warp yarns to be exited relative to each other and to position the layers of warp yarns to be exited relative to the other warp yarns 210, for example when the warp yarns to be exited must pass through more than four layers of warp yarns. Performing a rapier airpick 130 for each layer of warp yarns exited, or for each part of the layer of warp yarns exited, also allows more easily displacing the mass of warp yarns to be exited upwards while limiting the stress and friction in the harness 120. Furthermore, in the same weft column of the transition portion 202 to be made, the layers of warp yarns to be exited can be gradually exited one after the other, as illustrated in FIGS. 4 and 5. Thus, by multiplying the number of first sub-steps for each weft column, the number of simultaneous crossings between the warp yarns to be exited and the warp yarns of the surface layer is limited during each first sub-step, thus reducing the massive displacements of control yarns in the harness 120 and consequently reducing the friction and stress in the harness 120**.

FIGS. 4 to 11 illustrate the second step of the method of the invention, according to which the transition portion 202 of the texture 200 is made. In the example illustrated in FIGS. 4 to 11, it is desired to make the woven texture 200 of FIG. 3 whose second portion 203 comprises six fewer layers of warp yarns than the first portion 201, by removing three layers of warp yarns 211, 212, 216 through the upper layer of warp yarns **210*h* and by removing three layers of warp yarns 213, 214, 215 through the lower layer of warp yarns 210*b*. It is thus desired to make a transition portion 202 between the first and second portions 201 and 203 comprising a first weft column N, in which two layers of warp yarns 211 and 212 are removed through the upper layer of warp yarns 210*h* and two layers of warp yarns 213, 214 through the lower layer of warp yarns 210*b*, and a second weft column N+1, in which a fifth layer of warp yarns 215 is removed through the upper layer of warp yarns 210*h* and a sixth layer of warp yarns 216 through the lower layer of warp yarns 210*b***.

In the example illustrated in FIG. 4, the first step of weaving the first portion 201 of the texture 200 is completed and the second step of weaving the transition portion 202 of the texture 200 in the first weft column N is started. In FIG. 4, the first and second sub-steps are carried out a first time for the first layer of warp yarns 211 to be removed. Thus, the eyelets **121*a* through which the warp yarns of the first layer of warp yarns 211 to be exited are disposed above the eyelets 121*a* through which the other warp yarns 210 pass, so as to open a shed separating the first layer of warp yarns to be exited 211 from the other warp yarns 210. Thus, the shed also separates the first layer of warp yarns 211 to be exited from the other layers of warp yarns to be exited 212, 213, 214, 215, 216**.

Preferably, the lower and upper guide bars 171 and 172 of the guide device 170 of the woven texture 200 are also displaced along the vertical direction $D_V$ so as to place the first layer of warp yarns to be exited 211 above the reference path $T_{130}$ of the rapier 130 and so as to place the other layers of warp yarns below the reference path $T_{130}$ of the rapier 130.

Furthermore, the vertical position of the lower and upper guide bars 171 and 172 of the guide device 170 is determined so that, in each plane of the weaving loom 100 perpendicular to the reference path $T_{130}$ of the rapier 130, the length between the harness and the woven texture of the warp yarn of the upper layer of surface warp yarns **210*h* which delimits the lower edge of the shed is comprised between 90% and 110% of the length between the harness and the woven texture of the warp yarn of the first layer of warp yarns 211 to be removed which delimits the upper edge of the shed. This avoids significant differences in the length of yarns between the first layer of warp yarns 211 to be exited and the upper layer of surface warp yarns 210*h***, which facilitates the crossing between the warp yarns to be exited and the surface warp yarns without generating tension in the harness, in particular between the eyelets and the warp yarns passing therethrough.

Furthermore, the displacement of the guide device 170 from a first position to a second position after a rapier pick is carried out so that, in each plane of the weaving loom 100 perpendicular to the reference path $T_{130}$ of the rapier 130, the length between the harness and the woven texture of a warp yarn delimiting the lower edge of the shed when the guide device 170 is in the first position is comprised between 90% and 110% of the length between the harness and the woven texture of said warp yarn when it delimits the upper edge of the shed when the guide device is in the second position. Thus, the warp yarns switching from the lower edge of the shed to the upper edge of said shed after a rapier pick do not undergo excessive tension, thus facilitating yarn crossings.

At the end of this first sub-step, the first layer of warp yarns to be exited 211 is disposed above the reference path $T_{130}$ of the rapier 130 while the other layers of warp yarns are disposed below the reference path $T_{130}$ of the rapier 130. Thus, the other layers of warp yarns to be exited 212, 213, 214, 215, 216 are also disposed below the reference path $T_{130}$ of the rapier 130. A rapier airpick 130 is then performed in accordance with the second sub-step, as illustrated in FIG. 4.

Then, still in the first weft column N, the first and second sub-steps are carried out for the second layer of warp yarns to be removed 212, as illustrated in FIG. 5. Thus, the eyelets 121*a* through which the warp yarns of the first and second layers of warp yarns to be exited 211 and 212 pass are disposed above the eyelets 121*a* through which the other warp yarns pass, so as to open a shed separating the first and second layers of warp yarns to be exited 211 and 212 from the other warp yarns 210. Thus, the shed also separates the first and second layers of warp yarns to be exited 211 and 212 from the other layers of warp yarns to be exited 213, 214, 215, 216.

Preferably, at least one of the lower and upper guide bars 171 and 172 of the guide device 170 of the woven texture 200 is displaced upwards along the vertical direction $D_V$ so as to place the first and second layers of warp yarns to be exited 211 and 212 above the reference path $T_{130}$ of the rapier 130 and so as to place the other layers of warp yarns below the reference path $T_{130}$ of the rapier 130.

At the end of this first sub-step, the first and second layers of warp yarns to be exited 211 and 212 are disposed above the reference path $T_{130}$ of the rapier 130 while the other layers of warp yarns are disposed below the reference path $T_{130}$ of the rapier 130. Thus, the other layers of warp yarns to be exited 213, 214, 215, 216 are also disposed below the reference path $T_{130}$ of the rapier 130. A rapier airpick 130 is then performed in accordance with the second sub-step, as illustrated in FIG. 5.

In the example illustrated in FIGS. 4 to 10, only two layers of warp yarns 211 and 212 are removed through the upper layer of warp yarns 210*h* in the first weft column N of the transition portion 202 to be made. There is of course no departure from the framework of the invention if a single layer of warp yarns or more than two layers of warp yarns are removed through the upper layer of warp yarns in a weft column of the transition portion to be made. There is also no departure from the framework of the invention if the layer of warp yarns to be removed does not correspond to a complete layer of warp yarns in the weaving loom.

The first and second sub-steps can be carried out for each layer of warp yarns to be exited through the upper layer of warp yarns. However, there is of course no departure from the framework of the invention if the first and second sub-steps are carried out for only part of the layers of warp yarns exited through the upper layer of warp yarns.

For each weft column N, N+1 of the transition portion 202 to be made, when the desired layers of warp yarns have been exited through the upper layer of warp yarns 210*h*, the underlying layers of warp yarns to be woven are conventionally woven. Conventional weaving may comprise non-interlinkings. If it is not desired to exit warp yarns through the lower layer(s) of warp yarns in said weft column, all the layers of warp yarns to be woven may be conventionally woven. If it is desired to exit warp yarns through the lower layer(s) of warp yarns in said weft column, conventional weaving of all the underlying layers of warp yarns to be woven may be performed, excluding the lower layers of surface warp yarns, as illustrated in FIGS. 6 to 9.

The warp yarn layers 213 and 214 to be exited through the lower layer of surface warp yarns 210*b* along the vertical direction $D_V$ may also be exited by performing rapier airpicks to properly uncross the warp yarns.

For each weft column of the transition portion 202 to be made, if it is desired to remove from the weaving the warp yarns through the lower layer of surface warp yarns 210*b* along the vertical direction $D_V$, the sub-steps described below are carried out.

According to a third sub-step, the warp yarns to be removed, or the entire layer(s) of warp yarns to be removed, are disposed below the reference path $T_{130}$ of the rapier 130, and the warp yarns to be woven and any other warp yarns to be removed are disposed above the reference path $T_{130}$ of the rapier 130. If warp yarns have been exited through the lower layer of warp yarns 210*b* in the previous weft columns, these exited warp yarns are disposed below the reference path $T_{130}$ of the rapier 130 and below the warp yarns to be removed during this third sub-step.

A shed is thus created separating on the one hand the warp yarns to be removed, or the entire layer(s) of warp yarns to be removed, from the warp yarns to be woven and any other warp yarns to be removed, said shed comprising the reference path $T_{130}$ of the rapier 130. This configuration is obtained by actuating the control yarns 121 of the harness 120, so as to arrange the eyelets 121*a* through which the warp yarns to be removed pass below the eyelets 121*a* through which the rest of the warp yarns passes, with the exception of the warp yarns already exited through the lower layer of surface warp yarns 210*b*.

Preferably, this configuration is also obtained by arranging the lower and upper guide bars 171 and 172 of the guide device 170 of the woven texture 200 at a vertical position $D_V$ allowing the warp yarns to be removed or the entire layer(s) of warp yarns to be removed, to be disposed below the reference path $T_{130}$ of the rapier 130, and so as to arrange the rest of the warp yarns, with the exception of the warp yarns already exited through the lower layer of surface warp yarns, above the reference path $T_{130}$ of the rapier 130.

Preferably, the vertical position of the lower and upper guide bars 171 and 172 of the guide device 170 is determined so that, in each plane of the weaving loom 100 perpendicular to the reference path $T_{130}$ of the rapier 130, the length between the harness 120 and the woven texture 200 of the warp yarn which delimits the lower edge of the shed corresponds to between 90% and 110% of the length between the harness 120 and the woven texture 200 of the warp yarn which delimits the upper edge of the shed. The length between the harness 120 and the woven texture 200 is understood as the length between the point of said warp yarn present at the downstream end of the harness 120 and the point of said warp yarn present at the upstream end of the woven texture 200. Thus, significant differences in yarn length are avoided between the warp yarns to be removed placed above the reference path $T_{130}$ of the rapier 130 and the other warp yarns placed below the reference path $T_{130}$ of the rapier 130, which further reduces the risk of tension in the harness and facilitates the crossing between the warp yarns to be removed and the surface warp yarns.

Furthermore, the displacement of the guide device 170 from a first position to a second position after a rapier pick is carried out so that, in each plane of the weaving loom 100 perpendicular to the reference path $T_{130}$ of the rapier 130, the length between the harness and the woven texture of a warp yarn delimiting the lower edge of the shed when the guide device 170 is in the first position is comprised between 90% and 110% of the length between the harness and the woven texture of said warp yarn when it delimits the upper edge of the shed when the guide device is in the second position. Thus, the warp yarns switching from the lower edge of the shed to the upper edge of said shed after a rapier pick do not undergo excessive tension, thus facilitating yarn crossings.

When the warp yarns to be removed are properly placed relative to the other warp yarns and relative to the reference path $T_{130}$ of the rapier 130, a fourth sub-step is carried out according to which the rapier 130 is sent so that it passes through the weaving loom 100 along the reference path $T_{130}$ without drawing any weft yarn 130. Thus, the rapier 130 performs an airpick. This airpick allows in particular properly positioning the warp yarns to be exited relative to the other warp yarns. The reed 160 can be folded down after the airpick has been performed. The fourth sub-step is carried out after the third sub-step.

The third and fourth sub-steps can be repeated several times in each weft column of the transition portion 202 to be made when it is desired to remove from the weaving through the upper layer of surface warp yarns 210*h*, warp yarns belonging to different layers of warp yarns. Thus, the third and fourth sub-steps can be carried out for each layer of warp yarns to be exited through the lower surface layer 210*b*. Thus, by performing a rapier airpick 130 between each layer of warp yarns to be exited in the same weft column of the transition portion 202 to be made, it is easier to position the layers of warp yarns to be exited relative to each other and to position the layers of warp yarns to be exited relative to the other warp yarns. Performing a rapier airpick 130 for each layer of warp yarns exited also makes it easier to move the mass of warp yarns upwards by limiting the stress and friction in the harness 120. Furthermore, in the same weft column of the transition portion 202 to be made, the layers of warp yarns to be exited can be gradually exited one after the other. Thus, by multiplying the number of third sub-steps for each weft column, the number of simultaneous crossings between the warp yarns to be exited and the warp yarns of the surface layer is limited during each third sub-step, thus reducing the massive displacements of control yarns in the harness 120 and consequently reducing the friction and stress in the harness 120.

In the example illustrated in FIG. 10, the second weaving step of the transition portion 202 of the texture 200 is carried out in the second weft column N+1 after having completed the first weft column N. In FIG. 10, the third and fourth sub-steps are carried out for the fifth layer of warp yarns 215 to be exited. Thus, the eyelets 121*a* through which the warp yarns of the fifth layer of warp yarns 215 to be exited pass are disposed below the eyelets 121*a* through which the other warp yarns 210 pass except for the warp yarns of the third and fourth layers 213 and 214 already exited through the lower layer of surface warp yarns 210*b* in the weft column N, so as to open a shed separating the fifth layer of warp yarns to be exited 215 from the other warp yarns to be woven or exited.

Preferably, the lower and upper guide bars 171 and 172 of the guide device 170 of the woven texture 200 are also displaced along the vertical direction $D_V$ so as to place the fifth layer of warp yarns to be exited 215 below the reference path $T_{130}$ of the rapier 130 and so as to place the other layers of warp yarns to be woven or removed above the reference path $T_{130}$ of the rapier 130.

Furthermore, the vertical position of the lower and upper guide bars 171 and 172 of the guide device 170 is determined so that, in each plane of the weaving loom 100 perpendicular to the reference path $T_{130}$ of the rapier 130, the length between the harness and the woven texture of the warp yarn of the fifth layer of warp yarns to be removed 215 which delimits the lower edge of the shed corresponds to between 90% and 110% of the length between the harness and the woven texture of the warp yarn of the lower layer of surface warp yarns 210*b* which delimits the upper edge of the shed. Thus, significant differences in yarn length between the fifth layer of warp yarns 215 to be exited and the lower layer of surface warp yarns 210*b* are avoided, which facilitates the crossing between the warp yarns to be exited and the surface warp yarns without generating tension in the harness, in particular between the eyelets and the warp yarns passing therethrough.

Furthermore, the displacement of the guide device 170 from a first position to a second position after a rapier pick is carried out such that, in each plane of the weaving loom 100 perpendicular to the reference path $T_{130}$ of the rapier 130, the length between the harness and the woven texture of a warp yarn delimiting the lower edge of the shed when the guide device 170 is in the first position is comprised between 90% and 110% of the length between the harness and the woven texture of said warp yarn when it delimits the upper edge of the shed when the guide device is in the second position. Thus, the warp yarns switching from the lower edge of the shed to the upper edge of said shed after a rapier pick do not undergo excessive tension, thus facilitating yarn crossings.

At the end of this third sub-step, the fifth layer of warp yarns to be exited 215 is disposed below the reference path $T_{130}$ of the rapier 130 while the other layers of warp yarns to be woven or removed are disposed above the reference path $T_{130}$ of the rapier 130. Thus, the third and fourth layers of exited warp yarns 213 and 214 in the previous weft column N are also disposed below the reference path $T_{130}$ of the rapier 130, while the first and second layers of exited warp yarns 211 and 212 in the previous weft column N are disposed above the reference path $T_{130}$ of the rapier 130. A rapier airpick 130 is then performed in accordance with the fourth sub-step.

In the example illustrated in FIGS. 4 to 11, only one layer of warp yarns is removed through the lower layer of warp yarns 210*b* in the second weft column N+1 of the transition portion 202 to be made. There is of course no departure from the framework of the invention if several layers of warp yarns are removed through the lower layer of warp yarns in a weft column of the transition portion to be made. There is also no departure from the framework of the invention if the layer of warp yarns to be removed does not correspond to a complete layer of warp yarns in the weaving loom.

The third and fourth sub-steps can be carried out for each layer of warp yarns to be exited through the lower layer of warp yarns. The third and fourth sub-steps can also be carried out only for part of the layers of warp yarns exited through the lower layer of warp yarns.

Preferably, as illustrated in FIGS. 4 to 11, when the last rapier pick 130 of a weft column N has been performed in the lowest layers of warp yarns along the vertical direction $D_V$, the first rapier pick 130 is also performed in the following weft column N+1 in the lowest layers of warp yarns along the vertical direction $D_V$. Similarly, when the last rapier pick 130 of a weft column has been performed in the highest layers of warp yarns along the vertical direction, the first rapier pick 130 is also performed in the following weft column in the highest layers of warp yarns along the vertical direction $D_V$. This limits the massive displacements of layers of warp yarns in the harness and consequently reduces friction and stress on the control yarns 121.

As the transition portion 202 is woven, more and more yarns 211 to 216 are exited through the upper 210*h* and lower 210*b* layers of surface warp yarns, and must be kept away from the yarns being woven. Thus, the greater the number of layers of exited yarns 211 to 216, the more it is necessary to enlarge the amplitude of the shed opening, in order to properly position the exited yarns relative to the yarns to be woven. This prevents the crossings between the yarns to be woven and the exited yarns, thereby reducing the friction and the risk of defects. The angle of the shed opening is increased by keeping the eyelets through which the exited yarns pass in a very high or very low position in the harness. The increase of the shed opening is particularly significant when the number of layers of yarns exited through one of the upper or lower surface layers is greater than four. Indeed, when the number of layers of yarns exited through one of the upper or lower surface layers is for example greater than four, the friction between the yarns increases significantly if the shed opening is not adjusted.

According to one particular embodiment of the invention, the exited warp yarns can be interlinked. Thus, when making the weft columns N and N+1 of the transition portion 202 of the texture 200, one or more available weft yarns 220 can be used in the weft column N or N+1 of the transition portion 202 in order to interlink the exited warp yarns using the rapier airpicks in said weft column N or N+1.

The woven texture 200 obtained by the method of the invention may correspond to an abundant texture, which will be compacted to obtain a compacted texture with dimensions chosen and adapted to the use that will be made of said texture.

Thus, it is preferable to have a sufficient spacing between the lower guide bar 171 and the upper guide bar 172 of the guide device 170 so as not to distort the abundant texture 200, and to ensure that the texture will be correctly positioned in the correct vertical position during weaving in order to facilitate the crossing between the warp yarns to be exited and the layers of surface warp yarns. Consequently, preferably, during the weaving method according to the invention, the spacing between the lower guide bar 171 and the upper guide bar 172 of the guide device 170 must always be greater than a minimum value $H_{170}$ determined along the vertical direction $D_V$, as illustrated in FIGS. 4 to 9. This minimum spacing value $H_{170}$ of the guide bars 171 and 172 preferably corresponds to the product of the desired thickness for the compacted texture by 1.45. Indeed, it is estimated that the desired thickness for the compacted texture corresponds to approximately 40% of the abundant texture 200 present on the weaving loom.

Particularly, it may be desirable for the compacted texture obtained to have a volume rate of yarns of at least 58%. Thus, the minimum spacing value $H_{170}$ of the guide bars 171 and 172 is preferably calculated in the following manner, where $E_{58\%}$ is the desired thickness for the compacted preform with a fiber volume rate of 58%:

$$H_{170} = \frac{E_{58\%} \times 0.58}{0.40}$$

Furthermore, the execution of the warp yarn exited through the surface layers and the correct execution of the rapier airpicks require large height differences between the eyelets. The large amplitudes between the lowest eyelets and highest eyelets in the harness during warp yarn exits or during rapier airpicks can create significant tension if the spacing between the guide bars 171 and 172 remains fixed. Thus, preferably, when numerous warp yarn exits or a rapier airpick are performed, the spacing between the guide bars 171 and 172 can be increased by a certain value to facilitate the warp yarn crossings and thus the warp yarn exits. Thus, the guide bars 171 and 172 can be movable relative to each other along the vertical direction $D_V$.

According to one particular embodiment of the invention, the spacing of the guide bars is adjusted during each rapier pick, including during rapier airpicks. Thus, the spacing of the guide bars is adjusted each time the rapier passes through the weaving loom.

During the weaving of a weft column, when rapier airpicks are performed to remove layers of warp yarns through the upper layer of surface warp yarns, the spacing between the guide bars is increased for each rapier airpick. Thus, the spacing value of the guide bars 171 and 172 is $H_{170}+h_1$ along the vertical direction $D_V$ during the first rapier airpick, $h_1$ being a positive height, as illustrated in FIG. 4. The spacing value of the guide bars 171 and 172 is then $H_{170}+h_1+h_2$ along the vertical direction $D_V$ during the second rapier airpick, $h_2$ being a positive height, as illustrated in FIG. 5.

Preferably, in order to further facilitate yarn crossings, the increase in the spacing of the guide bars during the removal of one or more layers of warp yarns through the upper layer of surface warp yarns is carried out while the lower guide bar is fixed. Thus, only the upper guide bar, which is closest to the upper layer of surface warp yarns, is movable to allow the increase of the spacing between the guide bars during the withdrawal of one or more layers of warp yarns through the upper layer of surface warp yarns.

When the rapier airpicks for removing layers of warp yarns through the upper layer of surface warp yarns are completed and when the insertion of the weft yarns begins, the spacing between the guide bars is decreased for each rapier pick carrying a weft yarn. Thus, the spacing value of the guide bars 171 and 172 is $H_{170}+h_1+h_2-h_3$ along the vertical direction $D_V$ during the insertion of the first weft yarn, $h_3$ being positive, as illustrated in FIG. 6. The value of the spacing of the guide bars 171 and 172 is then $H_{170}+h_1+h_2-h_3-h_4$ along the vertical direction $D_V$ during the insertion of the second weft yarn, $h_4$ being positive, as illustrated in FIG. 7.

The value of the spacing between the guide bars can be decreased until the minimum value $H_{170}$ is obtained. Preferably, the reduction in the spacing of the guide bars until the minimum value $H_{170}$ is obtained is achieved while the upper guide bar is fixed. Thus, only the lower guide bar is movable to allow the reduction in the spacing between the guide bars until the minimum value $H_{170}$ is reached.

Preferably, if n rapier airpicks are performed for the removal of one or more layers of warp yarns through the upper layer of surface warp yarns, the minimum spacing value $H_{170}$ is reached during the $n^{th}$ insertion of a weft yarn. In the example illustrated in FIGS. 4 to 7, $h_1=h_2=h_3=h_4$: the minimum spacing value $H_{170}$ is therefore reached during the insertion of the second weft yarn.

When the weft yarn insertion continues after reaching the minimum spacing value $H_{170}$ between the guide bars, the spacing of the guide bars is maintained at said minimum spacing value $H_{170}$ for the subsequent weft yarn insertions. In order to avoid tension in the yarns as described above, the spacing value of the guide bar is maintained while said guide bars are movable along the vertical direction $D_V$ to adapt to the successive shed openings.

When rapier airpicks are performed to remove layers of warp yarns through the lower layer of surface warp yarns, the spacing between the guide bars can be increased again during the last weft yarn insertion(s) before the rapier airpicks. Preferably, if m rapier airpicks are performed for the removal of one or more layers of warp yarns through the lower layer of surface warp yarns, the spacing value of the guide bar is increased for the m last insertions of weft yarns.

Thus, the spacing value of the guide bars 171 and 172 is $H_{170}+h_5$ along the vertical direction $D_V$ during the penultimate insertion of a weft yarn, $h_5$ being a positive height, as illustrated in FIG. 8. The value of the spacing of the guide bars 171 and 172 is then $H_{170}+h_5+h_6$ along the vertical direction $D_V$ during the last insertion of a weft yarn, $h_6$ being a positive height, as illustrated in FIG. 9.

Preferably, the re-increase of the spacing of the guide bars for the last insertion(s) of weft yarns is carried out while the lower guide bar is fixed. Thus, only the upper guide bar is movable to allow the re-increase of the spacing between the guide bars.

When the rapier airpick(s) are performed to remove layers of warp yarns through the lower layer of surface warp yarns, the spacing between the guide bars is decreased for each rapier airpick (not represented).

The value of the spacing between the guide bars can be decreased until the minimum value $H_{170}$ is obtained for the last rapier airpick. Preferably, the reduction in the spacing of the guide bars until the minimum value $H_{170}$ is obtained while the upper guide bar is fixed. Thus, only the lower guide bar is movable to allow the decrease of the spacing between the guide bars until the minimum value $H_{170}$ is reached.

Thus, within the framework of the method of the invention, the first portion 201 of the texture 200 is woven during the first step, and the transition portion 202 of the texture 200 is woven during the second step.

During the second step, for each weft column of the transition portion 202 to be made and if it is desired to remove warp yarns through the upper surface layer 210*h*, the first and second sub-steps are carried out for each set of warp yarns to be removed through the upper surface layer 210*h*. Indeed, the first sub-step allows properly disposing the warp yarns on either side of the reference path by making the desired shed, and the second sub-step corresponds to a rapier airpick.

During the second step, for each weft column of the transition portion 202 to be made and if it is desired to remove warp yarns through the lower surface layer 210*b*, the third and fourth sub-steps are carried out for each set of warp yarns to be removed through the lower surface layer 210*b*. Indeed, the third sub-step allows properly disposing the warp yarns on either side of the reference path by making the desired shed, and the fourth sub-step corresponds to a rapier airpick.

In the example described above, for reasons of simplification, the exit of the warp yarns per entire layer is described in one time. However, in practice, a layer of warp yarns is generally exited in at least two times, or only part of the layer of warp yarns is exited. For example, to exit an entire layer of warp yarns, part of said layer is first exited by performing a rapier airpick, then the other part of said layer is exited by performing another rapier airpick.

In the example illustrated in FIGS. 3 to 11, the layers of surface warp yarns are continuous and made up of the same warp yarns along the entire length of the texture. However, there is no departure from the framework of the invention if the layers of surface warp yarns are made up of different warp yarns along the length of the texture.

The warp and weft yarns used in the present invention may be fibers, for example carbon, glass, or ceramic fibers, or a mixture of such fibers. Particularly, the woven texture may be made from fibers made up of the following materials: silicon carbide, alumina, mullite, silica, an aluminosilicate, a borosilicate, or a mixture of several of these materials.

The woven texture may thus be intended to form the fibrous reinforcement of a composite material part, for example a part made of ceramic matrix composite (CMC) or organic matrix composite (OMC) material. The woven texture can thus be intended to form the fibrous reinforcement of a composite material part of an aeronautical engine, for example an aeronautical engine blade. Indeed, the use of organic matrix composite (OMC) and ceramic matrix composite (CMC) materials on aeronautical engines, replacing the metal materials, contributes to optimizing aircraft performance, in particular by improving the efficiency of the turbomachine and by reducing the overall mass of the engine, thus significantly reducing the harmful emissions to the environment.

The invention claimed is:

1. A method for three-dimensionally weaving a texture between a plurality of layers of warp yarns superimposed along a vertical direction and a plurality of weft yarns extending along a horizontal direction, the weaving being performed by means of a weaving loom comprising a plurality of control yarns, a first end of each control yarn being connected to a Jacquard mechanism able to displace the control yarns along the vertical direction between a neutral position and at least one position for opening the warp yarns, each control yarn being further provided with an eyelet through which a warp yarn passes, the weaving loom further comprising at least one rapier present downstream of the control yarns able to pass through the weaving loom along a fixed horizontal reference path and to draw a weft yarn from a bobbin, wherein the method further comprises at least one warp exit step comprising:

displacing, along the vertical direction, all or part of the warp yarns of at least one underlying layer of warp yarns of the plurality of layers of warp yarns, said displaced warp yarns being intended to be exited from the texture, over a determined distance extending beyond a layer of warp yarns present on the surface of the plurality of layers of warp yarns, so that the displaced warp yarn(s) are disposed above the reference path and so that the rest of the non-exited warp yarns is disposed below the reference path, or so that the displaced warp yarn(s) are disposed below the reference path and so that the rest of the non-exited warp yarns are disposed above the reference path, then the rapier making an outward and return path through the weaving loom along the reference path without drawing any weft yarn.

2. The method according to claim 1, wherein during the weaving of at least one weft column, a plurality of underlying layers of warp yarns is intended to be exited from the texture beyond one of the warp yarn layers present on the surface of the plurality of layers of warp yarns, the following warp yarn exit step being repeated for each layer of warp yarns to be exited beyond said layer present on the surface:

displacing, along the vertical direction, the layer of warp yarns to be exited over a determined distance extending beyond the layer of warp yarns present on the surface of the plurality of layers of warp yarns, so that the displaced layer of warp yarns is disposed above the reference path and below the previously displaced layers of warp yarns intended to be exited from the texture and so that the rest of the non-exited warp yarns is disposed below the reference path, or so that the displaced layer of warp yarns is disposed below the reference path and above the previously displaced layers of warp yarns intended to be exited from the texture and so that the rest of the non-exited warp yarns is disposed above the reference path; then the rapier passing through the weaving loom along the reference path without drawing any weft yarns.

3. The method according to claim 1, wherein the warp yarn exit step further comprises, after the rapier has passed through the weaving loom without drawing any weft yarns:

part of the displaced warp yarns or part of the displaced layer moving along the vertical direction so that said part of the displaced warp yarns or of the displaced layer is disposed below the reference path and so that the other part of the displaced warp yarns or of the displaced yarn layer is disposed above the reference path, then the rapier passing through the weaving loom along the reference path by drawing a weft yarn so as to interlink the displaced warp yarns together.

4. The method according to claim 1, wherein the weaving loom further comprises a guide device present downstream of the plurality of control yarns and of the rapier, the guide device being able to move along the vertical direction so as to move the woven texture upwards or downwards relative to a horizontal reference plane comprising the reference path.

5. The method according to claim 4, wherein the guide device comprises an upper guide bar and a lower guide bar configured to be positioned in contact with the woven texture and on either side of said texture along the vertical direction, the minimum value of the spacing between the guide bars corresponding to the thickness of the non-compacted woven texture.

6. The method according to claim 5, wherein the spacing between the guide bars increases during the displacement along the vertical direction of all or part of the warp yarns intended to be exited from the texture over a determined distance extending beyond a layer of warp yarns present on the surface of the plurality of layers of warp yarns.

7. The method according to claim 5, wherein the guide bars of the guide device are configured to move along the vertical direction as a function of the vertical position of the eyelets of the harness during the displacement along the vertical direction of all or part of the warp yarns intended to be exited from the texture over a determined distance extending beyond a layer of warp yarns present on the surface of the plurality of layers of warp yarns, so that in each plane of the weaving loom perpendicular to the reference path, the length between the harness and the woven texture of the lowest warp yarn located above the reference path corresponds to between 90% and 110% of the length between the harness and the woven texture of the highest warp yarn located below the reference path.

8. The method according to claim 4, the guide device being configured to move between a first position and a second position along the vertical direction as a function of the vertical position of the eyelets of the harness after the displacement along the vertical direction of all or part of the warp yarns intended to be exited from the texture over a determined distance extending beyond a layer of warp yarns present on the surface of the plurality of layers of warp yarns, so that in each plane of the weaving loom perpendicular to the reference path, the length between the harness and the woven texture of the highest warp yarn located below the reference path when the guide device is in the first position is comprised between 90% and 110% of the length between the harness and the woven texture of said warp yarn when it is the lowest located above the reference path when the guide device is in the second position.

9. The method according to claim 1, wherein the warp and weft yarns are carbon, glass or ceramic fibers.

10. The method according to claim 1, wherein the woven texture is intended to form a fibrous reinforcement for a composite material part of an aeronautical engine.

* * * * *